US011661830B2

(12) United States Patent
Elliott et al.

(10) Patent No.: US 11,661,830 B2
(45) Date of Patent: May 30, 2023

(54) METHODS FOR PRODUCING HYDROCARBONS FROM THIN, HETEROGENOUS PAY RESERVOIRS USING VERTICALLY COPLANAR INJECTION AND PRODUCTION WELLS WITH A TRANSVERSE PRESSURE GRADIENT

(71) Applicant: Cenovus Energy Inc., Calgary (CA)

(72) Inventors: Chris Elliott, Calgary (CA); Jesse Clinton Keith, Calgary (CA)

(73) Assignee: Cenovus Energy Inc., Calgary (CA)

( * ) Notice: Subject to any disclaimer, the term of this patent is extended or adjusted under 35 U.S.C. 154(b) by 0 days.

(21) Appl. No.: 17/325,152

(22) Filed: May 19, 2021

(65) Prior Publication Data

US 2021/0363867 A1 Nov. 25, 2021

Related U.S. Application Data

(60) Provisional application No. 63/028,699, filed on May 22, 2020.

(51) Int. Cl.
*E21B 43/24* (2006.01)
*E21B 43/16* (2006.01)

(52) U.S. Cl.
CPC ..... *E21B 43/2406* (2013.01); *E21B 43/166* (2013.01)

(58) Field of Classification Search
CPC ..... E21B 43/2406; E21B 43/166
See application file for complete search history.

(56) References Cited

U.S. PATENT DOCUMENTS

2006/0175061 A1* 8/2006 Crichlow ..... E21B 43/2406 166/302
2007/0187103 A1* 8/2007 Crichlow ..... E21B 43/2408 166/302
2009/0188661 A1* 7/2009 Bizon ..... E21B 43/2406 166/268
2010/0012331 A1* 1/2010 Larter ..... E21B 43/243 166/401
2010/0096126 A1* 4/2010 Sullivan ..... E21B 43/243 166/260
2013/0118737 A1* 5/2013 Schneider ..... E21B 43/243 166/272.3
2014/0267097 A1* 9/2014 Lee ..... G06F 3/0416 361/679.01

FOREIGN PATENT DOCUMENTS

CA 2708188 A1 12/2010
CA 2757125 A1 * 2/2013 ..... E21B 43/18
CA 2991871 A1 7/2019

* cited by examiner

*Primary Examiner* — Silvana C Runyan
(74) *Attorney, Agent, or Firm* — Gordon & Jacobson, P.C.

(57) ABSTRACT

A method of producing hydrocarbons from a subterranean reservoir using laterally displaced and substantially vertically coplanar injection and production wells, in which at least one annulus-flow restrictor is positioned within the injection well diagonally opposed to a production inlet on the production well, so that injecting mobilizing fluid into the subterranean reservoir and producing mobilized hydrocarbons from the subterranean reservoir creates a transverse pressure gradient between the injection well and the production well.

19 Claims, 6 Drawing Sheets

METHODS FOR PRODUCING HYDROCARBONS FROM THIN, HETEROGENOUS PAY RESERVOIRS USING VERTICALLY COPLANAR INJECTION AND PRODUCTION WELLS WITH A TRANSVERSE PRESSURE GRADIENT

CROSS-REFERENCE TO RELATED APPLICATIONS

This application claims priority to and benefit of U.S. Provisional Patent Application Ser. No. 63/028,699 filed on May 22, 2020, the disclosure of which is incorporated herein by reference in its entirety.

TECHNICAL FIELD

The present disclosure generally relates to in situ hydrocarbon recovery methods. More specifically, the present disclosure relates to methods for hydrocarbon recovery from reservoirs comprising thin, heterogeneous pay zones.

BACKGROUND

Viscous hydrocarbons can be extracted from some subterranean reservoirs using in situ recovery processes. Some in situ recovery processes are thermal processes wherein heat energy is introduced to a reservoir to lower the viscosity of hydrocarbons in situ such that they can be recovered from a production well. In some thermal processes, heat energy is introduced by injecting a heated fluid such as steam, solvent, or a combination thereof into the reservoir by way of an injection well.

Example thermal-recovery processes include steam-assisted gravity drainage (SAGD), solvent-aided processes (SAP), and solvent-driven processes (SDP). These processes are also primarily gravity-driven processes. During operation, an injection fluid such as steam and/or solvent is injected into a subterranean reservoir via an injection well to form a production chamber—i.e. a volume of the reservoir in which mobile injection fluid exits for an extended period of time. Latent heat from the injection fluid is transferred to the formation to heat viscous hydrocarbons in the production chamber, which increases their mobility. After sufficient heat transfer, the viscous hydrocarbons are sufficiently mobilized to drain vertically under the influence of gravity toward a production well.

Gravity-driven thermal-recovery processes, however, are not well suited to produce hydrocarbons from some challenging reservoirs such as those comprising thin, heterogeneous pay zones. Thin, heterogeneous pay zones may include high-permeability hydrocarbon deposits bordered by, interbedded with, and/or interposed by low-permeability strata. Such geologic features can impact the process in three ways. First, these features often act as heat sinks in that they tend to receive substantial amounts latent heat from injection fluid without releasing commensurate hydrocarbons. Second, the low-permeability strata may limit the vertical-growth rate of production chamber, thereby reducing overall hydrocarbon production. Third, these low-permeability strata may act as barriers to the gravity drainage (i.e. primarily vertical flow) towards the production well. The first may impact the overall thermal efficiency of the process. The second and third may impact recovery rate and recovery factor.

Nonetheless, gravity-driven, thermal-recovery processes (e.g. SAGD, SAP, or SDP) are still employed for hydrocarbon production from thin, heterogeneous pay zones. In some instances, the processes may be modified by drilling well pairs closer together and/or by drilling redevelopment wells after production by initial wells declines, which may significantly increase the capital required to achieve the target recovery factor. As well, in some cases, the processes may be continued for longer than normal in attempt to partially drain hydrocarbons accumulated above the low-permeability strata, which may decrease the overall thermal efficiency of the process. There exists a need for alternate methods for hydrocarbon recovery from reservoirs comprising thin, heterogeneous pay zones. Alternative methods that mitigate excessive capital outlay and/or increase thermal efficiency are particularly desirable.

SUMMARY

The exploitation of thin, heterogeneous pay reservoirs is becoming increasingly relevant as producers look to diversify the formations from which they produce. For example, as the number of un-tapped, clean, and thick pay-zone containing reservoirs is progressively depleted, so-called "fringe" resources (e.g. thin, heterogeneous pay reservoirs) may be increasingly important.

In view of the foregoing, the present disclosure provides methods for producing hydrocarbons that may be suitable for exploiting thin, heterogeneous pay reservoirs. The methods of the present disclosure are somewhat atypical in that they do not rely on gravity as the primary driving force for hydrocarbon collection. Instead, they employ a lateral start up approach based on an unconventional well configuration that prioritizes lateral chamber development instead vertical chamber development. The methods of the present disclosure then utilize atypical well completion strategy to drive chamber development in a transverse fashion. The methods of the present disclosure may therefore be considered "transverse-drive" methods. As set out below, the transverse-drive methods of the present disclosure may be well suited to extract hydrocarbons from a thin, heterogeneous pay reservoir. The methods of the present disclosure may also be well suited to extract hydrocarbons from other types of reservoir pays, including thicker and/or more homogeneous pays as set out below.

The methods of the present disclosure were developed as a result of systematic reservoir-production simulations that take into account the complexities and particularities that arise when producing hydrocarbons from thin, heterogeneous pay reservoirs. Briefly stated, the investigations provided insights with respect to how transverse-drive methods may improve cumulative steam-oil ratio (cSOR), total recovery, and/or recovery rate as compared to typical SAGD processes in reservoirs such as thin, heterogeneous pay reservoirs.

Without being bound by any particular theory, the transverse-drive methods of the present disclosure may efficiently extract hydrocarbons from thin, heterogeneous pay reservoirs because mobilization occurs substantially parallel to barriers to vertical growth of the production chambers (e.g. low-permeability strata) and/or because the well pair configurations (i.e. laterally displaced wells) may reduce geometric constraints imposed by thin, heterogeneous pay reservoirs.

Accordingly, select embodiments of the present disclosure relate to a method of producing hydrocarbons from a subterranean reservoir, the method comprising: penetrating at least a portion of the subterranean reservoir with a first well and a second well, wherein after completion: the first well comprises a substantially-horizontal section that is equipped with a mobilizing-fluid injection outlet, the second well comprises a substantially-horizontal section that is equipped with a produced-fluid inlet, and the substantially-horizontal section of the second well is laterally displaced from the substantially-horizontal section of the first well; during a first production phase: positioning an annulus-flow restrictor within the substantially-horizontal section of the first well at a distance, $d_1$, from the produced-fluid inlet of the second well, injecting mobilizing fluid into the subterranean reservoir via the mobilizing-fluid injection outlet of the first well to mobilize hydrocarbons within the subterranean reservoir, and producing mobilized hydrocarbons from the subterranean reservoir via the produced-fluid inlet of the second well; and during a second production phase that is preceded by the first production phase: positioning an annulus-flow restrictor within the substantially-horizontal section of the first well at a distance, $d_2$, from the produced-fluid inlet of the second well such that $d_2<d_1$, injecting mobilizing fluid into the subterranean reservoir via the mobilizing-fluid injection outlet of the first well to mobilize hydrocarbons within the subterranean reservoir, and producing mobilized hydrocarbons from the subterranean reservoir via the produced-fluid inlet of the second well.

Select embodiments of the present disclosure relate to a method of producing hydrocarbons from a subterranean reservoir, the method comprising: penetrating at least a portion of the subterranean reservoir with a first well and a second well, wherein after completion: the first well comprises a substantially-horizontal section that is equipped with a mobilizing-fluid injection outlet, the second well comprises a substantially-horizontal section that is equipped with a produced-fluid inlet, and the substantially-horizontal section of the second well is laterally displaced from the substantially-horizontal section of the first well; during a first production phase: positioning an annulus-flow restrictor at a first position, $p_1$, within the substantially-horizontal section of the first well such that the first position of the annulus-flow restrictor, $p_1$, and the produced-fluid inlet of the second well together define an axis, $a_1$, that transects the substantially-horizontal section of the first well and the substantially-horizontal section of the second well, injecting mobilizing fluid into the subterranean reservoir via the mobilizing-fluid injection outlet of the first well to mobilize hydrocarbons within the subterranean reservoir, and producing mobilized hydrocarbons from the subterranean reservoir via the produced-fluid inlet of the second well; during a second production phase that is preceded by the first production phase: positioning an annulus-flow restrictor at a second position, $p_2$, within the substantially-horizontal section of the first well such that the second position, $p_2$, of the annulus-flow restrictor and the produced-fluid inlet of the second well together define an axis, $a_2$, that transects the substantially-horizontal section of the first well and the substantially-horizontal section of the second well, wherein the axis $a_1$ and the axis $a_2$ together define an angle, $\alpha$, about the produced-fluid inlet; injecting mobilizing fluid into the subterranean reservoir via the mobilizing-fluid injection outlet of the first well to mobilize hydrocarbons within the subterranean reservoir, and producing mobilized hydrocarbons from the subterranean reservoir via the produced-fluid inlet of the second well; and during a third production phase that is preceded by first production phase: positioning an annulus-flow restrictor at a third position, $p_3$, within the substantially-horizontal section of the first well such that the third position, $p_3$, of the annulus-flow restrictor and the produced-fluid inlet of the second well together define an axis, $a_3$, that transects the substantially-horizontal section of the first well and the substantially-horizontal section of the second well, wherein the axis $a_1$ and the axis $a_3$ together define an angle, $\beta$, about the produced-fluid inlet, and wherein the angle $\beta$ is greater than the angle $\alpha$; injecting mobilizing fluid into the subterranean reservoir via the mobilizing-fluid injection outlet of the first well to mobilize hydrocarbons within the subterranean reservoir, and producing mobilized hydrocarbons from the subterranean reservoir via the produced-fluid inlet of the second well.

Further, the present disclosure provides start-up processes that are suitable for use with the transverse-drive methods. In more detail, the start-up processes of the present disclosure are well suited to promote the initial lateral growth of a production chamber in a subterranean reservoir over a relatively short length of the well. This is in contrast to the start-up processes used in typical thermal-recover processes such as SAGD, SAP, and SDP, which promote growth of the production chamber primarily vertically, and relatively evenly across the entire length of the well pair.

Select embodiments of the present disclosure relate to a method of producing hydrocarbons from a subterranean reservoir, the method comprising: penetrating at least a portion of the subterranean reservoir with a first well, wherein the first well comprises a substantially-horizontal section that is equipped with a mobilizing-fluid injection outlet; injecting mobilizing fluid into the subterranean reservoir via the mobilizing-fluid injection outlet of the first well to form a production chamber within the subterranean reservoir; and forming a low-pressure point along the substantially horizontal portion of first well to facilitate the lateral growth of the production chamber.

Other aspects and features of the methods of the present disclosure will become apparent to those ordinarily skilled in the art upon review of the following description of specific embodiments.

BRIEF DESCRIPTION OF THE DRAWINGS

These and other features of the present disclosure will become more apparent in the following description in which reference is made to the appended drawings. The appended drawings illustrate one or more embodiments of the present disclosure by way of example only and are not to be construed as limiting the scope of the present disclosure.

FIG. 1B also shows reservoir characteristics of an example thin, heterogeneous pay reservoir.

DETAILED DESCRIPTION

Select embodiments of the present disclosure will now be described with reference to FIG. 1 through FIG. 5 without limiting the scope of the present disclosure.

As discussed above, the present disclosure relates to transverse-drive methods for hydrocarbon recovery. That is, in contrast to gravity-driven processes (e.g. typical SAGD, SAP, SDP processes) that involve the vertical drainage of mobilized hydrocarbons vertical direction, the methods of the present disclosure drive the hydrocarbons in a transverse direction across the reservoir. The transverse-drive methods may be suitable for extracting hydrocarbons from challenging reservoirs (e.g. from thin, heterogeneous pay reservoirs), for example because mobilization occurs substantially parallel to barriers to vertical growth of the production chambers (e.g. low-permeability strata) and/or because the laterally displaced wells may reduce geometric constraints imposed by thin, heterogeneous pay reservoirs.

Systematic reservoir-production simulations that take into account the complexities and particularities that arise when producing hydrocarbons from thin, heterogeneous pay reservoirs suggest that the transverse-drive methods of the present disclosure may afford improvements in cumulative steam-oil ratio (cSOR), total recovery, and/or recovery rate as compared to typical gravity-driven thermal-recovery processes. As well, due to one or more of these potential improvements, the methods of the present disclosure may reduce capital risk may be possible to enter the blowdown stage of the extraction process considerably earlier than typical gravity-driven thermal-recovery processes in thin, heterogeneous pay reservoirs.

In general, the transverse-drive methods of the present disclosure involve the use of a transverse, linear pressure gradient to laterally sweep the production chamber through the subterranean reservoir and thereby drive mobilized hydrocarbons transversely across the reservoir. While the transverse-drive methods of the present disclosure may benefit from gravity drainage to some extent, gravity drainage is not the dominant mechanism. This is in contrast to typical thermal-recovery processes, in which the dominant flow of mobilized hydrocarbons occurs in a vertical direction. As the transverse-drive methods use the pressure gradient to sweep the production chamber across the subterranean reservoir and to drive the flow of the mobilized hydrocarbons, the methods are therefore considered to be pressure dominant while typical thermal recovery processes (e.g. SAGD, SAP, or SDP processes) are considered to be gravity dominant.

Figure 1A:
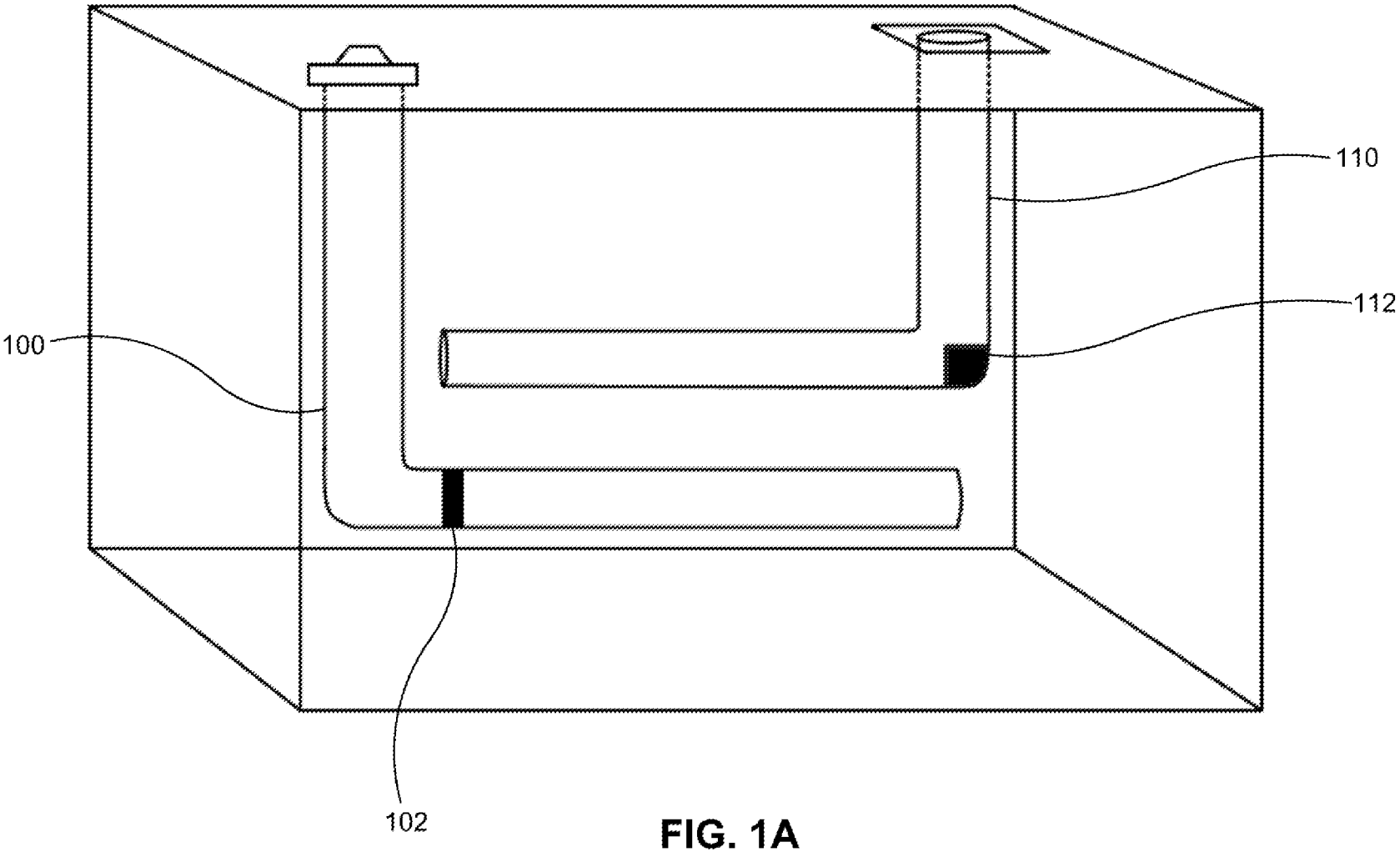
FIGS. 1A and 1B provide a perspective view of a transverse-drive well configuration according to a select embodiment of the present disclosure and an end-on profile view of the transverse-drive well configuration, respectively.

Referring now to FIG. 1A, there is provided a perspective view of a well configuration suitable for use with the start-up processes and transverse-drive methods of the present disclosure. FIG. 1A illustrates a first well 100 and a second well 110 that are positioned substantially in the same horizontal plane (see FIG. 1B). That is, the first well 100 and the second well 110 each have a horizontal section, and the horizontal sections are laterally displaced and substantially vertically coplanar. It is also shown that the first well 100 comprises an annulus-flow restrictor 102 and the second well comprises a produced-fluid inlet 112. The produced-fluid inlet 112 is diagonally opposed to the annulus-flow restrictor 102. As discussed above, the diagonally opposite relationship between the annulus-flow restrictor 102 and the produced-fluid inlet 112 creates a transverse pressure gradient, and this orientation may facilitate the flow of mobilized hydrocarbons through the reservoir substantially along the transverse pressure gradient (i.e. transverse drive). In the illustrated embodiment, the annulus flow restrictor 102 is a packer and the produced-fluid inlet 112 comprises a production pump. It is noted that, while the first well 100 and the second well 110 are substantially vertically coplanar, those skilled in the art who have benefited from the teachings of the present disclosure will recognize that horizontal wells often deviate and/or "meander" from such an orientation having regard to drilling and/or local reservoir geologies.

Figure 1B:
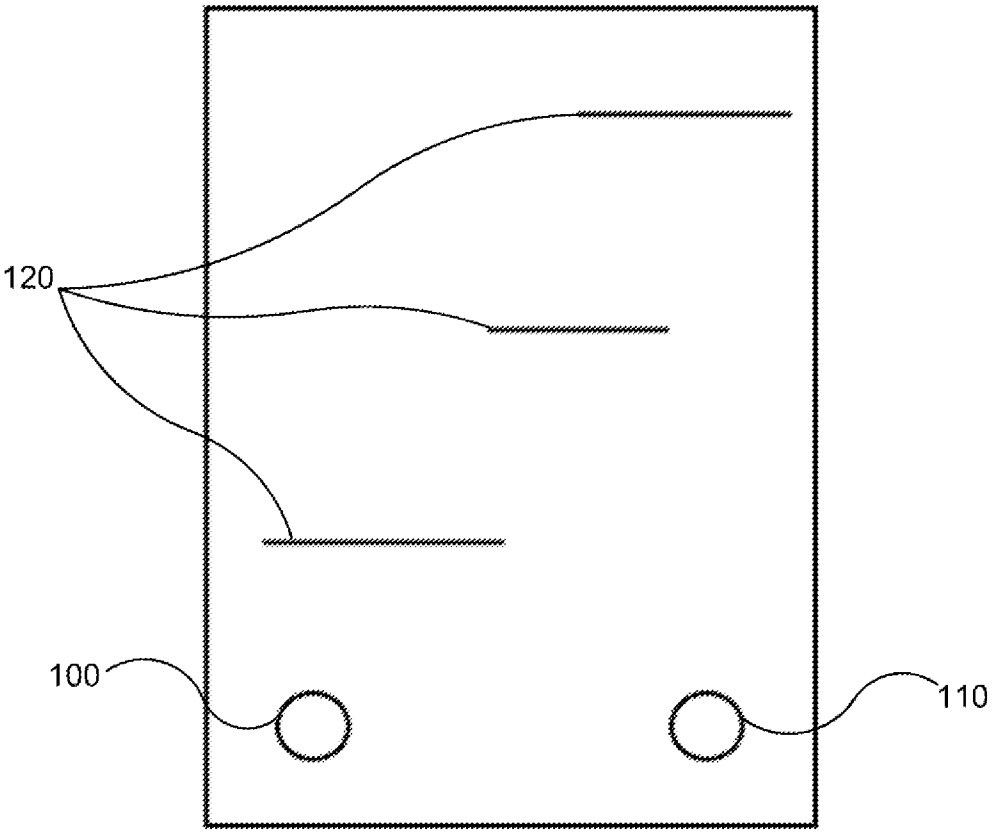

FIG. 1B, is a schematic, end-on view of the first well 100 and the second well 110 in a thin, heterogeneous pay reservoir (not shown to scale). The reservoir illustrated in FIG. 1B is a thin pay reservoir comprising low-permeability strata 120. Further, as previously discussed herein, the low-permeability strata 120, while each is illustrated as present in a single horizontal plane, they may be inclined such as is common in an inclined heterolithic strata (HIS). It is noted that, while the first well 100 and the second well 110 are located generally at the base of the reservoir, the present disclosure contemplates that there may be instances where it is beneficial to position the wells above the base (e.g. due to the location of low-permeability strata). Likewise, it is noted that, while the first well 100 and the second well 110 are substantially horizontal, those skilled in the art who have benefited from the teachings of the present disclosure will recognize that horizontal wells often deviate and/or "meander" from such an orientation having regard to drilling and/or local reservoir geologies.

Figure 2:
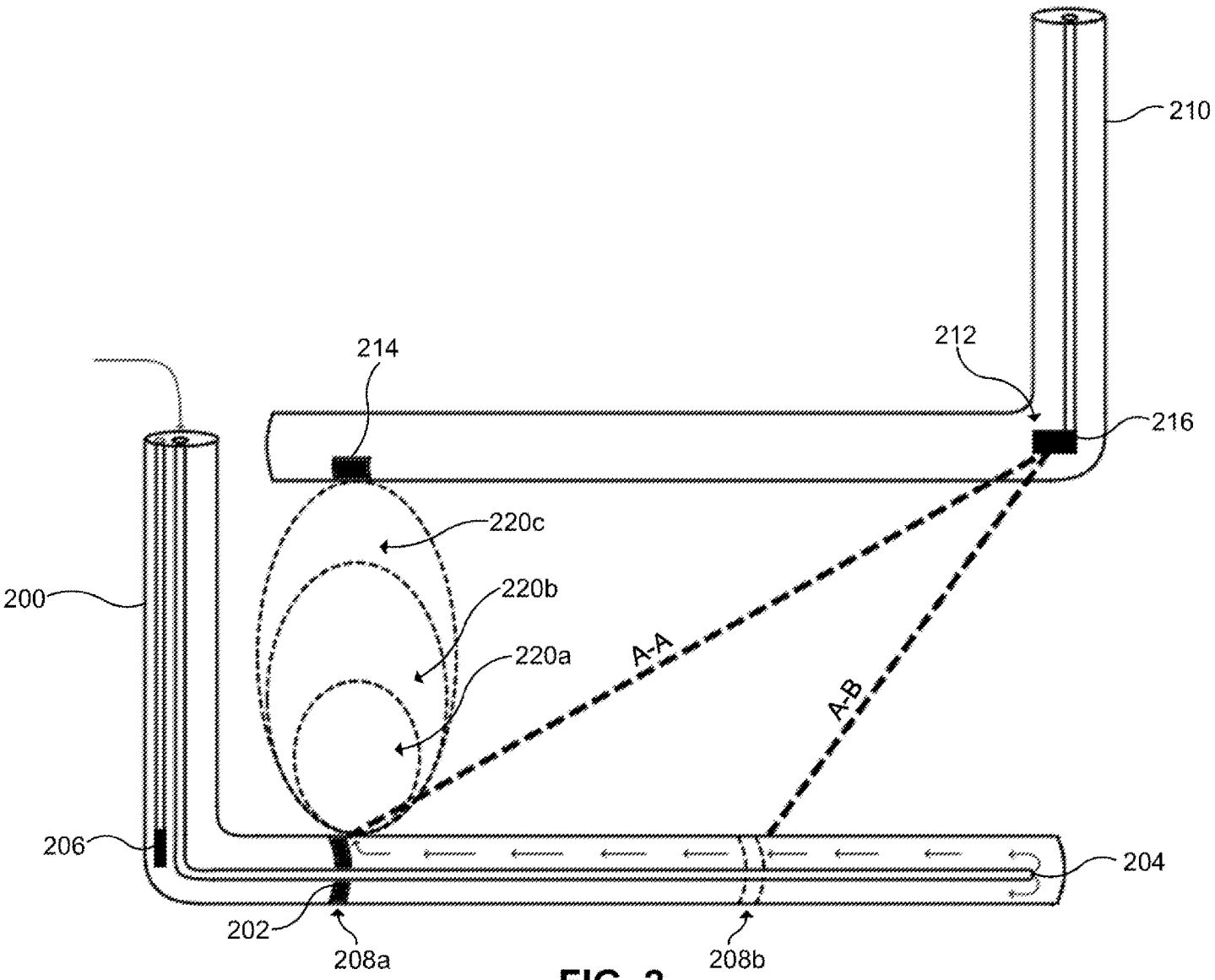
FIG. 2 shows a perspective view schematic of a start-up process and transverse-drive method according to a select embodiment of the present disclosure.

FIG. 2 shows a perspective view schematic of a start-up process for a transverse-drive method according to a select embodiment of the present disclosure. FIG. 2 shows a first well 200 and a second well 210, each of which has a horizontal section, where the horizontal sections are laterally displaced and vertically coplanar in the same manner as illustrated in FIG. 1B. The first well 200 comprises an annulus-flow restrictor 202 at a first position 208*a* and a mobilizing-fluid injection outlet 204. The first well 200 also comprises a start-up pump 206 in proximity to the annulus-flow restrictor 202. The second well 210 comprises a produced-fluid inlet 212 and a temperature sensor 214. In the same manner as FIG. 1A, the annulus flow restrictor 202 is a packer and the produced-fluid inlet 212 comprises a production pump 216.

In regards to the start-up process, as illustrated in FIG. 2, mobilizing fluid (indicated by the arrows) is injected via the mobilizing-fluid injection outlet 204 and flows to the annulus-flow restrictor 202. A nascent production chamber 220*a* is formed in proximity to the annulus-flow restrictor 202 by operating the start-up pump 206 to reduce local pressure and prioritize steam penetration in proximity to the annulus-flow restrictor 202 (i.e. localize chamber inception by voidage replacement).

Also during the start-up process, mobilizing fluid is injected substantially continuously into the reservoir and the nascent production chamber 220*a*, grows primarily in a lateral direction to form an intermediate production chamber 220*b* and subsequently a developed production chamber 220*c*. Conformance of the chamber during the start-up period may be modulated through the injection parameters at the mobilizing-fluid injection outlet 204 and the production parameters at the start-up pump 206.

As illustrated in FIG. 2, the developed production chamber 220*c* extends to a point proximal the temperature sensor 214 on the second well 210. As will be appreciated by those of ordinary skill in the art who have benefited from the teachings of the present disclosure, the developed production chamber 220*c* will have an increased temperature as compared to the remainder of the subterranean reservoir because of the latent heat of the injected mobilizing fluid. The temperature sensor 214 is configured to signal an increase of temperature to a temperature at which the hydrocarbons present in the subterranean reservoir become mobilized (e.g. to about 70° C.). This may be used as a trigger for terminating the start-up process and for initiating the transverse-drive method. More specifically, once the temperature sensor 214 reads a pre-determined temperature, the start-up pump 206 of the first well 200 may be stopped and the production pump 216 of the second well 210 may be started.

In the illustrated embodiment, stopping the pump 206 and starting the pump 216 causes the low-pressure point to move from a point proximal the heel of the first well 200 (i.e. where the start-up pump 206 is located) to a point proximal the heel of the second well 210 (i.e. where the production pump 216 is located). The change in location of the low-pressure point creates a transverse, substantially linear pressure gradient along line A-A extending between the annulus-flow restrictor 202 of the first well 200 and the production pump 216 of the second well 210. The transverse, linear pressure gradient drives the developed production chamber 220*c* laterally across the subterranean reservoir.

As previously discussed herein, hydrocarbon production will eventually start to decline as the developed production chamber 220*c* matures. The decline in production may trigger a recompletion of the well first well 200 wherein the annulus-flow restrictor 202 is shifted from the first position 208*a* to a second position 208*b*, thereby changing the primary entrance point of the mobilizing fluid into the subterranean reservoir. As well, the change in position of the annulus-flow restrictor 202 creates a new transverse, linear pressure gradient along line A-B. The new transverse, linear pressure gradient A-B laterally sweeps the developed production chamber 220*c* further across the subterranean reservoir. The recompletion of the well once hydrocarbon production declines may be repeated until the subterranean reservoir is depleted of hydrocarbons.

Figure 3:
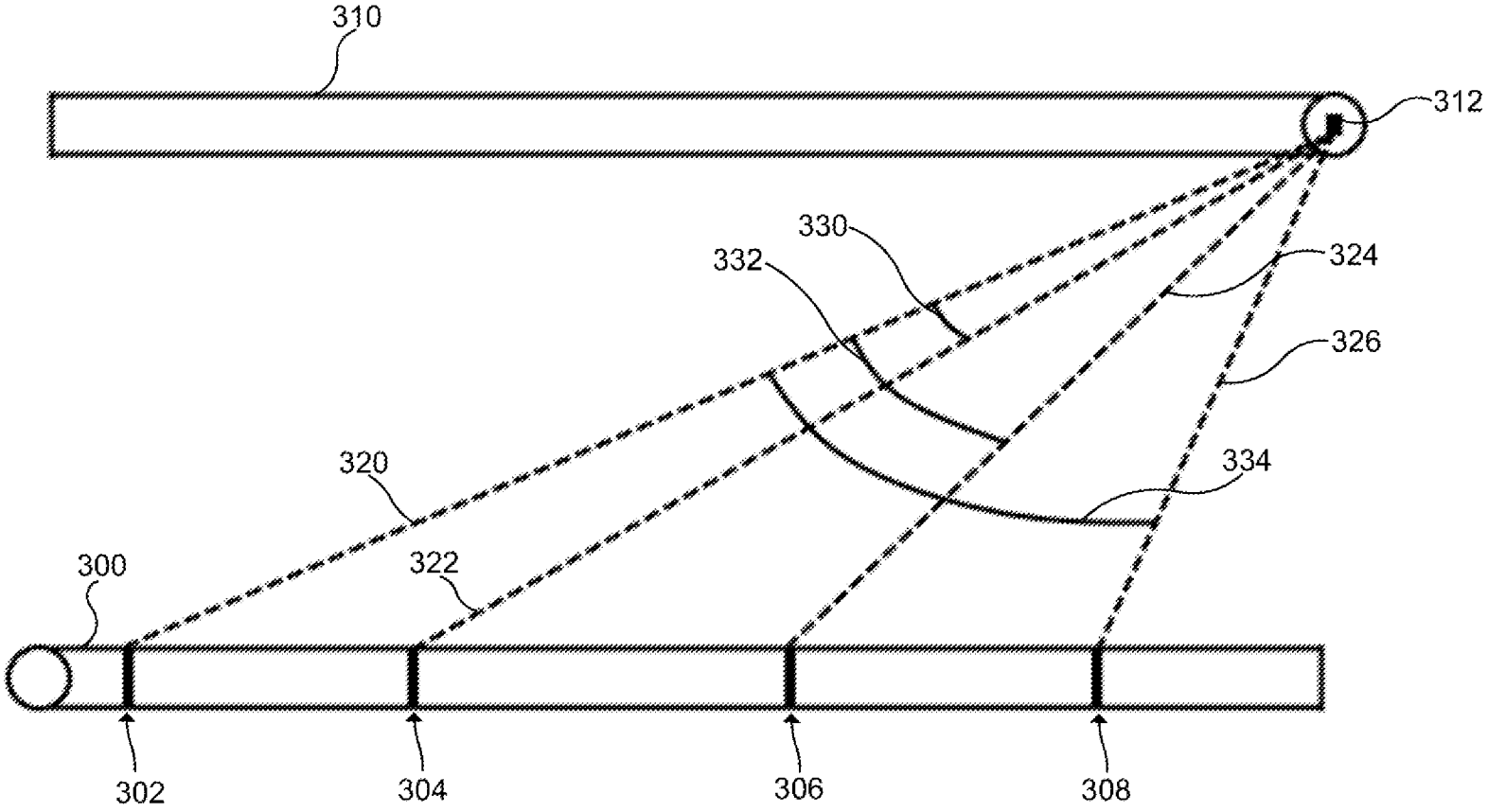
FIG. 3 provides a plan view of a transverse-drive well configuration showing the change in annulus-flow restrictor position over time according to a select embodiment of the present disclosure.

Referring now to FIG. 3, shows a plan view of a transverse-drive well configuration illustrating change in annulus-flow restrictor position over time. In more detail, there is shown a first horizontal well 300 and a second horizontal well 310. Along the first well 300 is a first annulus-flow restrictor position 302, a second annulus-flow restrictor position 304, a third annulus-flow restrictor position 306, and a fourth annulus-flow restrictor position 308. The second well 300 comprises a produced-fluid inlet 312. Lines 320, 322, 324, and 326 represent the distance between each of the positions 302, 304, 306, and 308, and the produced-fluid inlet 312, respectively.

As illustrated in FIG. 3 by way of the lines 320, 322, 324, and 326, the distance between the produced-fluid inlet and the annulus-flow restrictor positions 302, 304, 306, and 308 decreases from the first position 302 to the fourth position 308. For example, if line 320 has a length denoted "$d_1$", and line 322 has a length denoted "$d_2$", moving the annulus-flow restrictor from position 302 to position 304 decreases the distance between the produced-fluid inlet 312 and the annulus-flow restrictor, because $d_1>d_2$. Further, if line 324 has a length denoted "$d_3$", and line 326 has a length denoted "$d_4$", moving the annulus-flow restrictor from position 302 to position 304, to position 306, to position 308, decreases the distance between the produced-fluid inlet 312 and the annulus-flow restrictor, because $d_1>d_2>d_3>d_4$.

As illustrated in FIG. 3, advancing the annulus-flow restrictor along the well 300, also leads to increasing sweep angles formed between line 320 and lines 322, 324, and 326. For example, if the angle between: (i) lines 320 and 324 form a first angle 330 denoted "a", lines 320 and 324 form a second angle 332 denoted "β", and (iii) lines 320 and 326 form a third angle 334 denoted "δ", then $\alpha<\beta<\delta$.

Accordingly, the transverse-drive methods of the present disclosure may be characterized by: (i) at least one reduction in the distance between the annulus-flow restrictor and the produced-fluid inlet during recovery; and/or (ii) at least one increase in the angle about the produced-fluid inlet with respect to successive positions of the annulus-flow restrictor relative to the initial position of the annulus-flow restrictor in the injection well.

Select embodiments of the present disclosure relate to a method of producing hydrocarbons from a subterranean reservoir, the method comprising: penetrating at least a portion of the subterranean reservoir with a first well and a second well, wherein after completion: the first well comprises a substantially-horizontal section that is equipped with a mobilizing-fluid injection outlet, the second well comprises a substantially-horizontal section that is equipped with a produced-fluid inlet, and the substantially-horizontal section of the second well is laterally displaced from the substantially-horizontal section of the first well; during a first production phase: positioning an annulus-flow restrictor within the substantially-horizontal section of the first well at a distance, $d_1$ (not shown), from the produced-fluid inlet of the second well, injecting mobilizing fluid into the subterranean reservoir via the mobilizing-fluid injection outlet of the first well to mobilize hydrocarbons within the subterranean reservoir, and producing mobilized hydrocarbons from the subterranean reservoir via the produced-fluid inlet of the second well; and during a second production phase that is preceded by the first production phase: positioning an annulus-flow restrictor within the substantially-horizontal section of the first well at a distance, $d_2$ (not shown), from the produced-fluid inlet of the second well such that $d_2<d_1$, injecting mobilizing fluid into the subterranean reservoir via the mobilizing-fluid injection outlet of the first well to mobilize hydrocarbons within the subterranean reservoir, and producing mobilized hydrocarbons from the subterranean reservoir via the produced-fluid inlet of the second well.

Select embodiments of the present disclosure relate to a method of producing hydrocarbons from a subterranean reservoir, the method comprising: penetrating at least a portion of the subterranean reservoir with a first well and a second well, wherein after completion: the first well comprises a substantially-horizontal section that is equipped with a mobilizing-fluid injection outlet, the second well comprises a substantially-horizontal section that is equipped with a produced-fluid inlet, and the substantially-horizontal section of the second well is laterally displaced from the substantially-horizontal section of the first well; during a first production phase: positioning an annulus-flow restrictor at a first position, $p_1$, within the substantially-horizontal section of the first well such that the first position of the annulus-flow restrictor, $p_1$, and the produced-fluid inlet of the second well together define an axis, $a_1$, that transects the substantially-horizontal section of the first well and the substantially-horizontal section of the second well, injecting mobilizing fluid into the subterranean reservoir via the mobilizing-fluid injection outlet of the first well to mobilize hydrocarbons within the subterranean reservoir, and producing mobilized hydrocarbons from the subterranean reservoir via the produced-fluid inlet of the second well; during a second production phase that is preceded by the first production phase: positioning an annulus-flow restrictor at a second position, $p_2$, within the substantially-horizontal section of the first well such that the second position, $p_2$, of the annulus-flow restrictor and the produced-fluid inlet of the second well together define an axis, $a_2$, that transects the substantially-horizontal section of the first well and the substantially-horizontal section of the second well, wherein the axis $a_1$ and the axis $a_2$ together define an angle, $\alpha$, about the produced-fluid inlet; injecting mobilizing fluid into the subterranean reservoir via the mobilizing-fluid injection outlet of the first well to mobilize hydrocarbons within the subterranean reservoir, and producing mobilized hydrocarbons from the subterranean reservoir via the produced-fluid inlet of the second well; and during a third production phase that is preceded by the first production phase: positioning an annulus-flow restrictor at a third position, $p_3$, within the substantially-horizontal section of the first well such that the third position, $p_3$, of the annulus-flow restrictor and the produced-fluid inlet of the second well together define an axis, $a_3$, that transects the substantially-horizontal section of the first well and the substantially-horizontal section of the second well, wherein the axis $a_1$ and the axis $a_3$ together define an angle, $\beta$, about the produced-fluid inlet, and wherein the angle $\beta$ is greater than the angle $\alpha$; injecting mobilizing fluid into the subterranean reservoir via the mobilizing-fluid injection outlet of the first well to mobilize hydrocarbons within the subterranean reservoir, and producing mobilized hydrocarbons from the subterranean reservoir via the produced-fluid inlet of the second well.

As will be appreciated by those skilled in the art who have benefitted from the teachings of the present disclosure, the entrance point(s) at which mobilizing fluids enter the subterranean reservoir (i.e. the point(s) at which the production chamber forms) are typically higher in pressure than the surrounding reservoir. The transverse-drive methods of the present disclosure also involve forming a low-pressure point within the subterranean reservoir that is positioned away from the entrance point of the mobilizing fluid in a transverse direction. The difference in pressure between the entrance point of the mobilizing fluid and the low-pressure point forms the transverse, linear pressure gradient.

Further, the transverse-drive methods of the present disclosure also involve advancing the transverse, linear pressure gradient across the reservoir over time. In more detail, during one or more production phases, the production chamber is advanced in stages across the reservoir. This is primarily accomplished by changing the point at which the mobilizing fluid enters the reservoir while keeping the position of the low-pressure point substantially static. Changing the position of the entrance point of the mobilizing fluids relative to the low-pressure point changes the pressure gradient. The new pressure gradient laterally drives the production chamber across the subterranean reservoir, thereby mobilizing a wide area of hydrocarbons for subsequent production.

Further, as discussed above, the lateral drive of the production chamber across the subterranean reservoir may be substantially parallel with at least some low-permeability strata presenting in the reservoir. It is contemplated that the transverse-drive methods of the present disclosure are capable of mobilizing hydrocarbons on the upper surface of the low-permeability strata because the production chamber is driven laterally across both the upper and lower surfaces of the low-permeability strata. In contrast, production chamber growth in gravity-driven thermal-recovery processes is primarily vertical and therefore substantially perpendicular to the general deposition planes of the low-permeability strata. Accordingly, the transverse-drive methods of the present disclosure present a potential advantage over gravity-driven thermal recovery processes in the present context, because gravity-driven thermal-recovery processes: (i) may require excessive time to allow for chamber growth; and/or (ii) may not effectively sweep mobilized hydrocarbons in proximity to low-permeability strata. In contrast, while the transverse-drive methods of the present disclosure may benefit from gravity drainage to some extent, gravity drainage is not the dominant mechanism.

In the context of the present disclosure, the word "hydrocarbon" is generally used interchangeably with "petroleum" and/or "oil" to refer to mixtures of widely varying composition, as will be evident from the context in which the word is used. It is common practice to categorize hydrocarbon substances of high viscosity and density into two categories, "heavy oil" and "bitumen". For example, some sources define "heavy oil" as a hydrocarbon-containing mixture that has a mass density of greater than about 900 kg/m$^3$. Bitumen is sometimes described as that portion of a hydrocarbon-containing mixture that exists in the semi-solid or solid phase in natural deposits, with a mass density greater than about 1000 kg/m$^3$ and a viscosity greater than about 10,000 centipoise (cP; or 10 Pa·s) measured at original temperature in the deposit and atmospheric pressure, on a gas-free basis. Although these terms are in common use, references to heavy oil and bitumen represent categories of convenience, and there is a continuum of properties between heavy oil and bitumen. Accordingly, references to heavy oil and/or bitumen herein include the continuum of such substances, and do not imply the existence of some fixed and universally recognized boundary between the two substances. In particular, the term "heavy oil" includes within its scope all "bitumen" including hydrocarbons that are present in semi-solid or solid form.

In the context of the present disclosure, a "reservoir" or "hydrocarbon-bearing formation" is a subsurface formation containing one or more natural accumulations of moveable hydrocarbons, which are generally confined by relatively impermeable rock. An "oil sand" reservoir is generally comprised of strata of sand or sandstone containing viscous hydrocarbons, such as bitumen. Viscous petroleum, such as bitumen, may also be found in reservoirs whose solid structure consists of carbonate material rather than sand material. Such reservoirs are sometimes referred to as "bituminous carbonates".

In the context of the present disclosure, the permeability of the hydrocarbon-bearing formation refers to the degree to which hydrocarbons can flow through the hydrocarbon-bearing formation. High-permeability hydrocarbon-bearing formations are those having permeabilities of greater than about 10 mD and include but are not limited to those that are sand-dominated and that have sand facies. High-permeability formations are often bordered by, interbedded with, and/or interposed by low-permeability strata such as shale lamina and mud clasts. Low-permeability strata are layers of material that have a permeability of less than about 10 mD. Inclined heterolithic strata (IHS)—heterogeneous deposits that include layers of high-permeability material and low-permeability material and that offset from their depositional plane—are one such example. IHS typically consist of repeating cycles of interbedded sand-dominated layers and mud-dominated layers. Geophysical data suggests that, in at least some instances, IHS result from lateral growth of large-scale bedforms such as point bars. IHS are typically classified based on their volume percentage of mud-dominated material. IHS comprising greater than 30 vol. % mud-based materials are said to be mud-dominated IHS, and IHS comprising less than 30 vol. % are said to be sand-dominated IHS.

In the context of the present disclosure, the term "mobilizing fluid" is intended to refer to liquids or gases that are injected into a reservoir to mobilize hydrocarbons contained therein. Such fluids may include steam, solvents, non-condensable gases (NCG), or a combination thereof. For example, the solvents may comprise propane, butane, diluent, natural gas condensate, or a combination thereof. The NCG may comprise methane, ethane, $O_2$, $CO_2$, $N_2$, CO, $H_2S$, $H_2$, $NH_3$, flue gas, or a combination thereof.

In the in the context of the present disclosure, the term "mobilizing-fluid injection outlet" refers to the outlet from which the mobilizing fluid exits an injection string of a well.

In the context of the present disclosure, the term "annulus-flow restrictor" refers to a device or combination of devices that determine an entrance-point at which the mobilizing fluid enters the reservoir. As will be appreciated by those of ordinary skill in the art, during injection, the mobilizing fluid flows through an injection string and into an annulus formed between the injection string and the casing of the well via the mobilizing-fluid injection outlet. In the context of the present disclosure, the position of the annulus-flow restrictor determines where the mobilizing fluid exits the annulus and enters the reservoir. The annulus-flow restrictor may be positioned away from the mobilizing-fluid injection outlet such that the mobilizing fluid has to travel along a length of the well after exiting the mobilizing-fluid injection outlet before entering the reservoir. One such example, is an embodiment of the present disclosure as shown schematically in FIG. 2, wherein the mobilizing-fluid injection outlet is proximal to the toe of the well, and the annulus-flow restrictor is a packer that is initially positioned proximal to the heel of the well. In other embodiments of the present disclosure, the annulus-flow restrictor may comprise the mobilizing-fluid injection outlet such that the mobilizing fluid does not have to travel along a length of the horizontal section of the well before entering the reservoir. One such example, is an embodiment of the present disclosure, wherein the annulus-flow restrictor comprises an outflow control device (OCD) that is positioned between two packers. Such embodiments may comprise a plurality of OCDs that may be sequentially activated to facilitate the methods of the present disclosure.

In the context of the present disclosure, the term "produced-fluid inlet" refers to a device or combination of devices that produce mobilized hydrocarbons. The produced-fluid inlet may be used to form a low-pressure point in the subterranean reservoir, as discussed above. Produced fluid inlets may comprise a pump or a gas lift, both of which are known to those of ordinary skill in the art. In the context of the present disclosure, a pump may be referred to as a "start-up pump" (i.e. a pump used during the start-up phase" or a "production pump" (i.e. a pump used during the production phase). Those skilled in the art will appreciate that these terms to not imply any particular configuration, and that they are terms of convenience for explaining the transition from nascent chamber growth to lateral drive.

In the context of the present disclosure, the expression "preceded by" is intended to encompass both directly and indirectly preceded by.

In select embodiments of the present disclosure, the first and the second well are arranged such that the heels of each of the first and second well are aligned—i.e. the heels of the first and second wells are on the same side. Alternatively, in other embodiments, the first and the second well are arranged heel-to-toe. In order to afford a full lateral drive across the reservoir, it may be beneficial to position the annulus-flow restrictor diagonally opposite the produced-fluid inlet. For example, the annulus-flow restrictor and the produced-fluid inlet may be arranged on opposite ends of the substantially horizontal section of the first and second wells, respectively. Such arrangements allow a greater distance for the advancement of the annulus-flow restrictor within the substantially-horizontal section of the well. In more detail, when the produced-fluid inlet and the annulus-flow restrictor are diagonally opposed, there is a greater horizontal distance between the two components. Thus, the annulus-flow restrictor has a greater distance such that it may be advanced within the substantially horizontal section of the well, thereby providing more opportunities to change the transverse, linear pressure gradient between the annulus-flow restrictor and the produced-fluid inlet to laterally drive the production chamber across the subterranean reservoir.

Thus, in embodiments where the heels of the first and second wells are aligned, the annulus-flow restrictor may therefore be located proximal the heel of the first well during the first production phase and the produced fluid inlet may be located proximal the toe of the second well. In embodiments where the first and second wells are instead arranged heel-to-toe, the annulus-flow restrictor may be located proximal the heel of the first well during the first production phase and the produced-fluid inlet may be located proximal the heel of the second well.

Further, it is noted that, in select embodiments of the present disclosure, the substantially-horizontal sections of each of the first well and the second well comprise the toe and/or the heel of each of the first and the second well. As will be appreciated by those of ordinary skill in the art, the exact location of the toe and the heel of a well may change based on the configuration of the well. For example, depending on the length of the well and the angle at which it penetrates the subterranean reservoir, the toe and/or heel of the well may be located proximal the substantially-horizontal section of the well or, alternatively, may be located therealong.

In select embodiments, the positioning of the annulus-flow restrictor during a subsequent production phase (i.e. the second and/or third production phase) comprises moving the annulus-flow restrictor along the substantially-horizontal section of the first well to a new position. As described above, the produced-fluid inlet, which may be used to form a low-pressure point within the subterranean reservoir, is positioned within the horizontal section of the second well. Thus, moving the annulus-flow restrictor within the substantially-horizontal section of the first well changes the entrance point of the mobilizing fluid into the subterranean reservoir relative to the position of the produced-fluid inlet, which, as discussed above, changes the transverse, linear pressure gradient formed therebetween. The new pressure gradient acts to drive the production chamber laterally across the subterranean reservoir in the manner previously described herein. In certain embodiments, the annulus-flow-restrictor may be a packer. Those of ordinary skill in the art are familiar with packers and their functionality. The packer may be moved along the substantially-horizontal section of the well in order to change the entrance point of the mobilizing fluid into the subterranean reservoir and progressively sweep the production chamber laterally along the reservoir.

In other embodiments, the positioning of the annulus-flow restrictor during a subsequent production phase (i.e. the second and/or third production phase) comprises activating an annulus-flow restrictor located at another position (e.g. at $d_2$, $p_2$, and/or $p_3$). That is, in such embodiments, the first well may be equipped with a plurality of annulus-flow restrictors. In order to laterally drive the production chamber through the reservoir, a first annulus-flow restrictor may be shut off and a second annulus-flow restrictor positioned a distance away from the first may be activated, thereby changing the entrance point of the mobilizing fluid into the subterranean reservoir and, in turn, the pressure gradient formed between the entrance point and the produced fluid-inlet. In such embodiments, the annulus-flow restrictor may comprise an outflow control device (OCD) positioned between two packers. Those of ordinary skill in the art are familiar with OCDs. Thus, in such embodiments, the annulus-flow restrictor may be advanced through the reservoir by progressively deactivating and activating OCDs positioned along the length of the substantially-horizontal section of the first well in order to change the pressure gradient and progressively sweep the production chamber laterally along the reservoir.

According to select embodiments of the present disclosure, the transverse-drive methods may further comprise one or more production phases. That is, briefly stated, the transverse-drive methods may involve positioning an annulus-flow restrictor within the substantially-horizontal section of the first well, and injecting fluid into the subterranean reservoir, and producing mobilized hydrocarbons one or more times. For example, there may be an additional one, two, three, four, five, six, seven, eight, nine, or ten production phases. Of course, as will be appreciated, there may be as many production phases as necessary in order to deplete the subterranean reservoir of hydrocarbons.

Further, in select embodiments of the present disclosure where the positioning of the annulus-flow restrictor within the substantially-horizontal section of the first well is completed based on the distance of the annulus-flow restrictor from the produced-fluid inlet of the second well, the distance between $d_1$ and $d_2$ is about 100 m to about 150 m. The distance between $d_1$ and $d_2$ may be: about 100 m to about 125 m; about 125 m to about 150 m; or about 110 m to about 140 m. In a particular embodiment, the distance between $d_1$ and $d_2$ is about 130 m.

Similarly, in select embodiments of the present disclosure where the positioning of the annulus-flow restrictor within the substantially-horizontal section of the first well is completed based on the angles formed between axes defined between the position of the produced-fluid inlet and the position of the annulus flow reactor, the distance between $p_1$ and $p_2$ and/or the distance between $p_2$ and $p_3$ is about 100 m to about 150 m. The distance between $p_1$ and $p_2$ and/or the distance between $p_2$ and $p_3$ may be: about 100 m to about 125 m; about 125 m to about 150 m; or about 110 m to about 140 m. In a particular embodiment, the distance between $p_1$ and $p_2$ and/or between $p_2$ and $p_3$ is about 130 m.

According to select embodiments, the distance between the annulus-flow restrictor and the produced-fluid inlet during the first production phases is about 80 m to about 120 m. In certain embodiments, the distance between the annulus-flow restrictor and the produced-fluid inlet during the first production phases is: (i) about 80 m to about 100 m; about 100 m to about 120 m; or about 90 m to about 110 m. In particular embodiments, the distance between the annulus-flow restrictor and the produced-fluid inlet during the first production phase is about 100 m.

Further, in select embodiments of the present disclosure, the first well and the second well may be positioned in the same horizontal plane. As discussed above, the first and second wells are at least laterally displaced. The lateral offset allows for the formation of the transverse, linear pressure gradient between the annulus-flow restrictor and the produced-fluid inlet, as described above. However, in other embodiments, the first and second wells may also be vertically offset. The vertical offset may be by design (e.g. to account for low-permeability strata present within the subterranean reservoir) or may instead be the result of one of both of the first and second wells meandering to account drilling and/or reservoir complexities.

As well, in select embodiments the substantially-horizontal sections of the substantially-horizontal sections of each of the first and the second well may be parallel. However, it is also contemplated that the substantially-horizontal sections of the well may be angularly offset. That is, the substantially-horizontal sections of each of the wells may converge together or diverge away from each other. In further embodiments, the first and second well may be positioned about 30 m to about 100 m away from each other. In certain embodiments, the first well and the second well may be positioned (i) about 30 m to about 50 m; (ii) about 50 m to about 80 m; or (iii) about 80 m to about 100 m away from each other. In a particular embodiment, the first well and the second well are positioned about 50 m away from each other.

According to select embodiments of the present disclosure, the subterranean reservoir is a thin pay reservoir. In the context of the present disclosure, thin pay reservoirs have a height of about 5 m to about 15 m. In certain embodiments, the reservoir has a height of: (i) about 8 m to about 12 m; (ii) about 5 m to about 8 m; or (iii) about 12 m to about 15 m. Of course, as will be appreciated from the description provided herein, the methods of the present disclosure may be suitable for use in reservoirs having a height greater or less than the defined ranges. For example, in select embodiments of the present disclosure, the subterranean reservoir is a thick pay reservoir. In the context of the present disclosure, thick pay reservoirs have a height of greater than about 15 m. In certain embodiments, the thick pay reservoir has a height of: (i) about 15 m to about 18 m; (ii) about 18 m to about 22 m; or (iii) about 22 m to about 25 m.

According to select embodiments, the subterranean reservoir comprises one or more low-permeability strata. As discussed above, the subterranean reservoir may be bordered by, interbedded with, and/or interposed by the one or more low-permeability strata. Further, in some embodiments, the one or more low-permeability strata have a permeability of less than about 10 mD. The one or more low-permeability strata may be in the form of generally horizontal layers. Alternatively, in some embodiments, the one or more low-permeability strata comprise inclined heterolithic strata. Further, as discussed above, the one or more low-permeability strata may comprise shale lamina and/or mud clasts. Of course, as will be appreciated from the description provided herein, the methods of the present disclosure may be suitable for use in reservoirs that are substantially homogeneous. In the context of the present disclosure, a homogeneous reservoir is: (i) one having a permeability of greater than about 10 mD, and (ii) one that is not substantially bordered by, interbedded with, and/or interposed by one or more low-permeability strata.

Further, in select embodiments of the present disclosure, the subterranean reservoir may be under native conditions prior to the penetrating of the subterranean reservoir. In the context of the present disclosure, a reservoir under "native conditions" refers to a reservoir that has not been substantially influenced by a prior thermal-recovery process (e.g. SAGD, SAP, or SDP). Alternatively, in other embodiments, the subterranean reservoir has been pre-heated by a prior thermal-recovery process. For example, the transverse-drive methods of the present disclosure may be used to access a thin pay attic that has been conductively pre-heated by an earlier thermal-recovery process.

As discussed above, the transverse-drive methods of the present disclosure may benefit start-up processes that has been modified with respect to those typically used for thermal-recovery processes such as SAGD, SAP, and SDP. In more detail, as discussed above, the transverse-methods of the present disclosure involve the lateral sweep of a production chamber. As will be appreciated, it may be possible to laterally sweep a production chamber formed using a start-up process standard to thermal-recovery processes such as SAGD, SAP, or SDP. However, it may be both more thermally and resource efficient to employ a start-up process that promotes the initial lateral growth of the production chamber, rather than one that promotes primarily the vertical growth thereof, as is done in those used for gravity-driven thermal-recovery processes.

Accordingly, select embodiments of the present disclosure relate to a method of producing hydrocarbons from a subterranean reservoir, the method comprising: penetrating at least a portion of the subterranean reservoir with a first well, wherein the first well comprises a substantially-horizontal section that is equipped with a mobilizing-fluid injection outlet; injecting mobilizing fluid into the subterranean reservoir via the mobilizing-fluid injection outlet of the first well to form a production chamber within the subterranean reservoir; and forming a low-pressure point along the substantially horizontal portion of first well to facilitate the lateral growth of the production chamber.

Forming the low-pressure point along the substantially-horizontal portion of the first well facilitates the lateral growth of the production chamber. Without being bound by any particular theory, it is contemplated that the positioning of the low-pressure point along the substantially-horizontal section from which the mobilizing fluid is injected initiates voidage replacement within the subterranean reservoir, thereby localizing a nascent production chamber. In select embodiments, the injecting the mobilizing fluid and the forming of the low-pressure point occur simultaneously. Further, in select embodiments, the forming of the low-pressure point comprises running a pump located at the heel of the first well to draw produced hydrocarbons.

Further, in select embodiments, the start-up processes of the present disclosure further comprise positioning an annulus-flow restrictor within the substantially horizontal section of the first well to direct flow of the mobilizing fluid into the subterranean reservoir. The annulus-flow restrictor may be configured in the same manner as described above in relation to the transverse-drive methods. For example, the annulus-flow restrictor may be a packer. Further, the annulus flow-restrictor may be positioned at a point proximal the heel of the first well. As well, in some embodiments, the low-pressure point is proximal the heel of the first well.

According to select embodiments, the start-up process features a second well having a substantially-horizontal section that is laterally displaced from the substantially-horizontal section of the first well. In such embodiments, the second well may comprise a temperature sensor on the substantially-horizontal section thereof. In some embodiments, the temperature sensor is positioned on the second well such that it is laterally aligned with an annulus-flow restrictor on the first well. The temperature sensor may be used to indicate when the forming of the low-pressure point can be terminated. For example, the forming of the low-pressure point may be terminated when the temperature sensor on the second well reads a temperature at which hydrocarbons in the subterranean reservoir mobilize (e.g. about 70° C.). Of course, as will be appreciated, the exact temperature used to trigger the termination of the low-pressure point may change depending on a variety of parameters, such as the composition of the subterranean reservoir.

It is noted that, in the start-up processes of the present disclosure, the mobilizing fluid and reservoir characteristics may be the same as those described above in relation to the transverse-drive methods.

Further, while the start-up processes have been generally described in relation to the transverse-drive methods of the present disclosure, it will be appreciated that the start-up processes may have broader applications and thus are not limited to use with the transverse-drive methods.

EXAMPLES

Example 1: Percent Recovery of Transverse-Drive Methods Vs. SAGD

A reservoir-production simulation was performed to compare the % recovery of a transverse-drive method according to a select embodiment of the present disclosure to that of a typical SAGD process in a thin, heterogeneous pay subterranean reservoir. For the simulation, the transverse-drive method used steam as a mobilizing fluid. A select embodiment of the start-up process of the present disclosure was used prior to initiating the transverse-drive. As well, the reservoir had a total height of 9 m, with 6 m being rich in hydrocarbons and 3 m being non-rich in hydrocarbons. The reservoir also had a number of low-permeability strata comprised of mud clasts.

Figure 4:
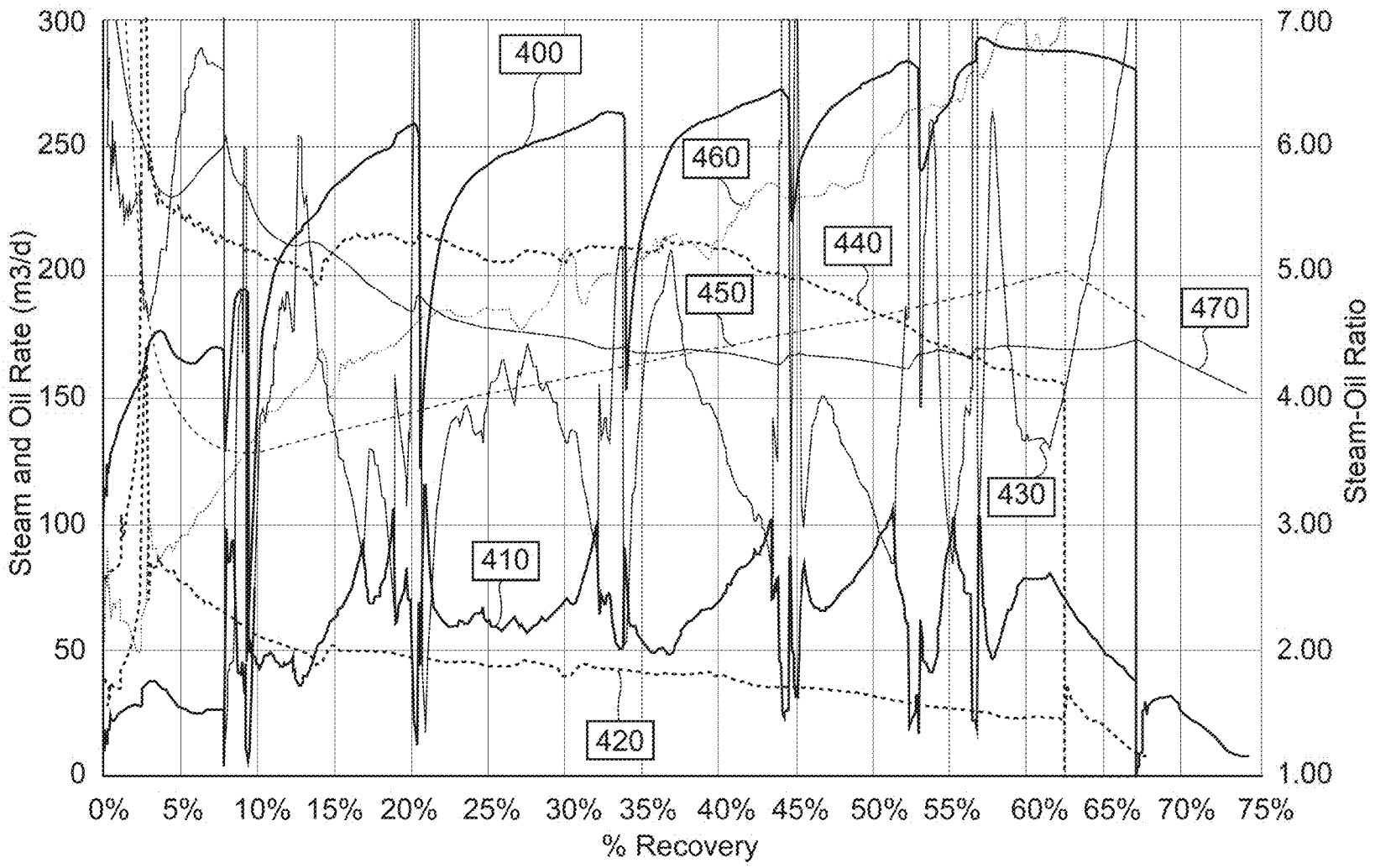
FIG. 4 is a production plot comparing the % recovery of a transverse-drive method according to a select embodiment of present disclosure and a typical SAGD process in a thin, heterogeneous pay reservoir.

FIG. 4 shows the results of the test formatted as a line graph. In regards to the transverse-drive methods of the present disclosure, line 400 represents the amount of steam injected into the reservoir, line 410 represents the amount of oil produced from the reservoir, line 430 represents the instantaneous steam-oil ratio (iSOR), and line 470 represents the cumulative steam-oil ratio (cSOR). In regards to the SAGD process, line 440 represents the amount of steam injected into the reservoir, line 420 the amount of oil produced from the reservoir, line 460 represents the ISOR, and line 450 represents the cSOR.

FIG. 4 illustrates that the transverse-drive methods of the present disclosure are capable of a significant increase in produced oil from thin, heterogeneous reservoirs. The transverse-drive methods achieved a % recovery of about 74% (see line 400), while the SAGD process only achieved a % recovery of about 67% (see line 420).

Example 2: Performance of Transverse-Drive Methods Vs. SAGD Over Time

Another reservoir-production simulation was performed using the same start-up process, transverse-drive method, and reservoir conditions as outlined above in Example 1. In this case, however, the production of each of the transverse-drive methods and the SAGD process were monitored over time.

Figure 5:
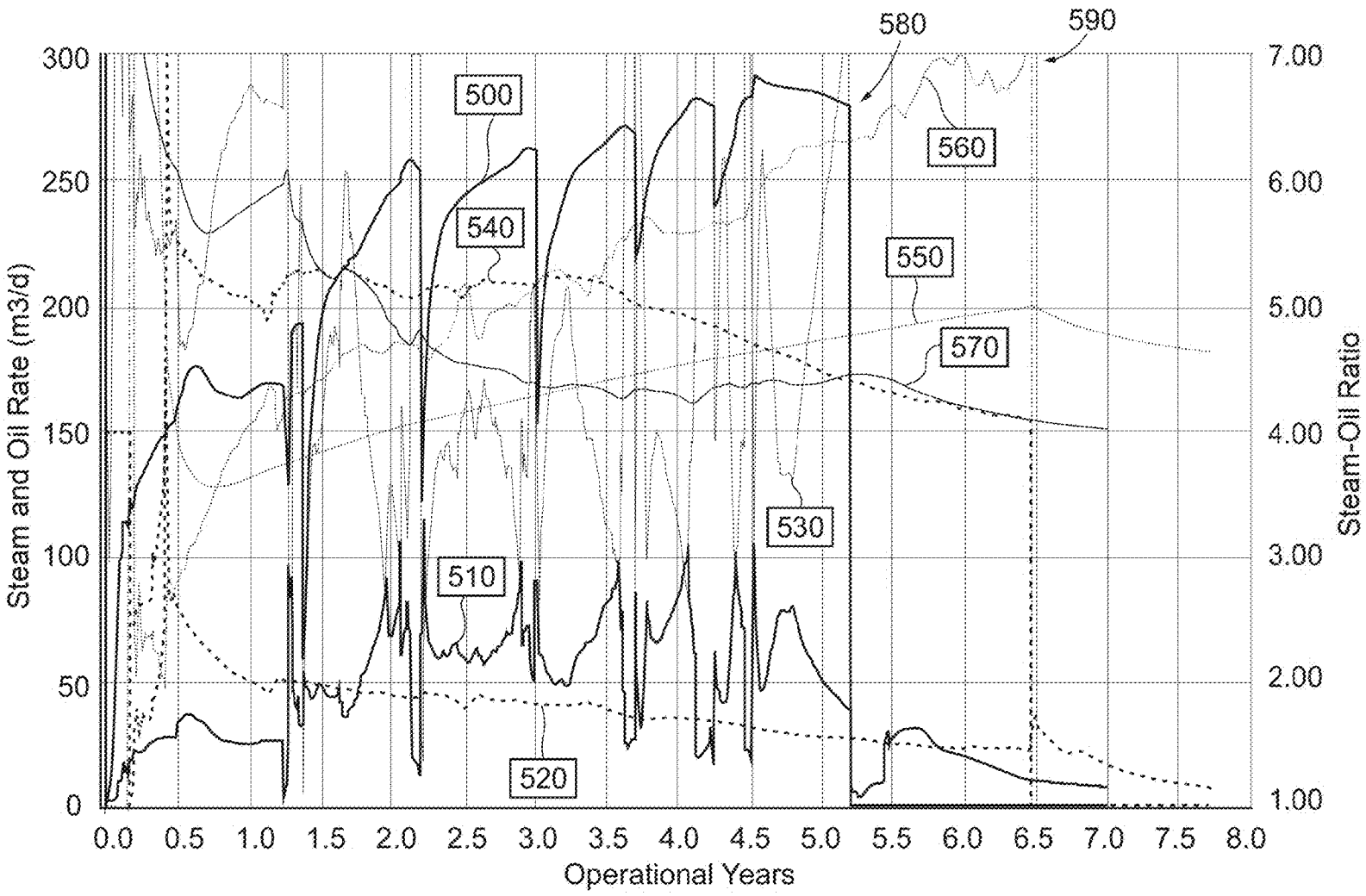
FIG. 5 is a production plot comparing the production of a transverse-drive method according to a select embodiment of present disclosure and a typical SAGD process in a thin, heterogeneous pay reservoir over time.

FIG. 5 shows the results of the test formatted as a line graph. In regards to the transverse-drive methods of the present disclosure, line 500 represents the amount of steam injected into the reservoir, line 510 represents the amount of oil produced from the reservoir, line 530 represents the instantaneous steam-oil ratio (iSOR), and line 570 represents the cumulative steam-oil ratio (cSOR). In regards to the SAGD process, line 540 represents the amount of steam injected into the reservoir, line 520 the amount of oil produced from the reservoir, line 560 represents the iSOR, and line 550 represents the cSOR.

FIG. 5 illustrates that the SAGD process outperforms the transverse-drive methods of the present disclosure in terms of oil production (see lines 510 and 520) for about the first 1.25 years, at which point the start-up process is terminated and the transverse-drive method is initiated. It is contemplated that this is a result of the SAGD process developing better conformance and drainage than that developed during the start-up process of the present disclosure. However, once the transverse-method is initiated, the oil production of the SAGD process is surpassed.

Further, it is also illustrated that blowdown (triggered by an iSOR of 7.0) for the transverse-drive method of the present disclosure occurs about 1.25 years before that of the SAGD process. For clarity, the point at which blowdown for the transverse-drive method is indicated by 580 and the point at which blowdown occurs for the SAGD process is indicated by 590.

It is also shown that the ultimate recovery of the transverse-drive method occurs about 9 months prior to the ultimate recovery of the SAGD process (see the points at which lines 510 and 520 terminate).

In regards to cSOR, it is illustrated that, while the SAGD process has a superior cSOR for the first 3.5 years, the transverse-drive method achieves a final cSOR value that is superior to that of the SAGD process. A comparison of the lines 550 and 570 shows that the transverse-drive method achieves a final cSOR of about 4.0, while the SAGD process achieves a final value of about 4.6.

In the present disclosure, all terms referred to in singular form are meant to encompass plural forms of the same. Likewise, all terms referred to in plural form are meant to encompass singular forms of the same. Unless defined otherwise, all technical and scientific terms used herein have the same meaning as commonly understood by one of ordinary skill in the art to which this disclosure pertains.

As used herein, the term "about" refers to an approximately +/−10% variation from a given value. It is to be understood that such a variation is always included in any given value provided herein, whether or not it is specifically referred to.

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Although individual embodiments are discussed, the disclosure covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure. If there is any conflict in the usages of a word or term in this specification and one or more patent(s) or other documents that may be incorporated herein by reference, the definitions that are consistent with this specification should be adopted.

Many obvious variations of the embodiments set out herein will suggest themselves to those skilled in the art in light of the present disclosure. Such obvious variations are within the full intended scope of the appended claims.

The invention claimed is:

1. A method of producing hydrocarbons from a subterranean reservoir, the method comprising:

penetrating at least a portion of the subterranean reservoir with a first well and a second well, wherein after completion:

the first well comprises a substantially-horizontal section that is equipped with a mobilizing-fluid injection outlet, the second well comprises a substantially-horizontal section that is equipped with a produced-fluid inlet, and the substantially-horizontal section of the second well is laterally displaced from and substantially vertically coplanar with the substantially-horizontal section of the first well;

during a first production phase:

positioning a first annulus-flow restrictor within the substantially-horizontal section of the first well at a distance, $d_1$, from the produced-fluid inlet of the second well, injecting mobilizing fluid into the subterranean reservoir via the mobilizing-fluid injection outlet of the first well to mobilize hydrocarbons within the subterranean reservoir, and producing mobilized hydrocarbons from the subterranean reservoir via the produced-fluid inlet of the second well; and during a second production phase subsequent to the first production phase:

positioning a second annulus-flow restrictor within the substantially-horizontal section of the first well at a distance, $d_2$, from the produced-fluid inlet of the second well wherein $d_2<d_1$, injecting mobilizing fluid into the subterranean reservoir via the mobilizing-fluid injection outlet of the first well to mobilize hydrocarbons within the subterranean reservoir, and producing mobilized hydrocarbons from the subterranean reservoir via the produced-fluid inlet of the second well;

wherein:

the first annulus-flow restrictor and the second annulus-flow restrictor are a single moveable annulus-flow restrictor, wherein the second production phase comprises moving the single moveable annulus-flow restrictor along the substantially-horizontal portion of the first well from the distance $d_1$ to the distance $d_2$; or the first annulus-flow restrictor and the second annulus-flow restrictor are spaced apart along the first well, wherein the positioning of the second annulus-flow restrictor during the second production phase comprises deactivating the first annulus-flow restrictor and activating the second annulus-flow restrictor.

2. The method of claim 1, wherein the mobilizing fluid is steam, a solvent, a non-condensable gas (NCG), or a combination thereof.

3. The method of claim 1, wherein the subterranean reservoir is a thin pay reservoir having a height of 5 m to 15 m.

4. The method of claim 1, wherein the subterranean reservoir comprises one or more low-permeability strata having a permeability less than about 10 mD.

5. The method of claim 1, wherein heels of each of the first and second well are aligned.

6. The method of claim 5, wherein the produced-fluid inlet is located adjacent a toe of the second well.

7. The method of claim 1, wherein the first and the second well are arranged heel-to-toe.

8. The method of claim 7, wherein the produced-fluid inlet is located proximal a heel of the second well.

9. The method of claim 1, wherein the substantially-horizontal section of the first well is generally parallel to the substantially-horizontal section of the second well.

10. The method of claim 1, wherein the substantially-horizontal sections of each of the first and the second well are angularly offset.

11. The method of claim 1, wherein the distance, $d_1$, between the first annulus-flow restrictor and the produced-fluid inlet during the first production phase is about 80 m to about 120 m.

12. A method of producing hydrocarbons from a subterranean reservoir, the method comprising:

penetrating at least a portion of the subterranean reservoir with a first well and a second well, wherein after completion:

the first well comprises a substantially-horizontal section that is equipped with a mobilizing-fluid injection outlet, the second well comprises a substantially-horizontal section that is equipped with a produced-fluid inlet, and the substantially-horizontal section of the second well is laterally displaced from and substantially vertically coplanar with the substantially-horizontal section of the first well;

during a first production phase:

positioning a first annulus-flow restrictor at a first position, $p_1$, within the substantially-horizontal section of the first well, the first position of the first annulus-flow restrictor, $p_1$, and the produced-fluid inlet of the second well together defining an axis, $a_1$, that transects the substantially-horizontal section of the first well and the substantially-horizontal section of the second well, injecting mobilizing fluid into the subterranean reservoir via the mobilizing-fluid injection outlet of the first well to mobilize hydrocarbons within the subterranean reservoir, and producing mobilized hydrocarbons from the subterranean reservoir via the produced-fluid inlet of the second well;

during a second production phase subsequent to the first production phase:

positioning a second annulus-flow restrictor at a second position, $p_2$, within the substantially-horizontal section of the first well, the second position, $p_2$, of the second annulus-flow restrictor and the produced-fluid inlet of the second well together defining an axis, $a_2$, that transects the substantially-horizontal section of the first well and the substantially-horizontal section of the second well, wherein the axis $a_1$ and the axis $a_2$ together define an angle, $\alpha$, about the produced-fluid inlet;

injecting mobilizing fluid into the subterranean reservoir via the mobilizing-fluid injection outlet of the first well to mobilize hydrocarbons within the subterranean reservoir, and producing mobilized hydrocarbons from the subterranean reservoir via the produced-fluid inlet of the second well; and during a third production phase that is subsequent to the second production phase:

positioning a third annulus-flow restrictor at a third position, $p_3$, within the substantially-horizontal section of the first well, the third position, $p_3$, of the third annulus-flow restrictor and the produced-fluid inlet of the second well together defining an axis, $a_3$, that transects the substantially-horizontal section of the first well and the substantially-horizontal section of the second well, wherein the axis $a_1$ and the axis $a_3$ together define an angle, $\beta$, about the produced-fluid inlet, and wherein the angle $\beta$ is greater than the angle $\alpha$;

injecting mobilizing fluid into the subterranean reservoir via the mobilizing-fluid injection outlet of the first well to mobilize hydrocarbons within the subterranean reservoir, and producing mobilized hydrocarbons from the subterranean reservoir via the produced-fluid inlet of the second well;

wherein:

the first, second and third annulus-flow restrictors are a single moveable annulus-flow restrictor, the positioning of the second and third annulus-flow restrictors during the second and third production phases, respectively, comprising moving the single moveable annulus-flow restrictor along the substantially-horizontal portion of the first well to position $p_2$ or $p_3$, respectively; or the first, second and third annulus-flow restrictors are spaced apart along the first well, wherein the positioning of the second annulus-flow restrictor during the second production phase comprises deactivating the first annulus-flow restrictor and activating the second annulus-flow restrictor located at the position $p_2$; and the positioning of the third annulus-flow restrictor during the third production phase comprises deactivating the second annulus-flow restrictor and activating the third annulus-flow restrictor located at the position $p_3$.

13. The method of claim 12, wherein the subterranean reservoir is a thin pay reservoir having a height of 5 m to 15 m.

14. The method of claim 12, wherein the subterranean reservoir comprises one or more low-permeability strata having a permeability less than about 10 mD.

15. The method of claim 12, wherein heels of each of the first and second well are aligned.

16. The method of claim 12, wherein the first and the second well are arranged heel-to-toe.

17. The method of claim 12, wherein the substantially-horizontal section of the first well is generally parallel to the substantially-horizontal section of the second well.

18. The method of claim 12, wherein the substantially-horizontal sections of each of the first and the second well are angularly offset.

19. The method of claim 12, wherein the distance between the first annulus-flow restrictor and the produced-fluid inlet during the first production phase is about 80 m to about 120 m.

* * * * *